US005815837A

United States Patent [19]

Christman et al.

[11] Patent Number: 5,815,837

[45] Date of Patent: Oct. 6, 1998

[54] SLEEVED GARMENT HAVING RETRACTABLE HAND WARMERS

[76] Inventors: Rodney Gene Christman; Amy Jo Kasza-Christman, both of R.R.#3, Box 255, Richfield Springs, N.Y. 13439

[21] Appl. No.: 824,842

[22] Filed: Mar. 26, 1997

[51] Int. Cl.[6] ..... A41D 27/10

[52] U.S. Cl. ..... 2/158; 2/123; 2/125

[58] Field of Search ..... 2/115, 123, 125, 2/126, 158, 159

[56] References Cited

U.S. PATENT DOCUMENTS

| | | | |
|---|---|---|---|
| Re. 7,759 | 6/1877 | Silva | 2/158 X |
| 361,250 | 4/1887 | Wright . | |
| 1,014,653 | 1/1912 | Kronenberger | 2/158 X |
| 1,092,047 | 3/1914 | Hertz | 2/158 X |
| 1,183,792 | 5/1916 | Aron | 2/158 X |
| 1,275,837 | 8/1918 | Biggs | 2/158 |
| 1,296,966 | 5/1919 | Kaufman | 2/158 X |
| 1,310,120 | 7/1919 | Kreamer | 2/158 |
| 2,314,922 | 3/1943 | Chanut | 2/159 |
| 2,315,889 | 4/1943 | Wells | 2/158 |
| 2,323,136 | 6/1943 | Johanson | 2/158 |
| 2,497,262 | 2/1950 | Jacobson | 2/123 X |
| 2,836,828 | 6/1958 | Henrikson | 2/158 |
| 3,677,130 | 7/1972 | O'Hayer | 2/158 X |
| 4,297,746 | 11/1981 | Zarbos | 2/158 X |
| 4,359,784 | 11/1982 | Harrington . | |
| 4,559,647 | 12/1985 | Smith et al. | 2/158 |
| 4,756,027 | 7/1988 | Buenos et al. | 2/159 X |
| 4,773,100 | 9/1988 | Kuo | 2/159 X |
| 4,980,929 | 1/1991 | Long | 2/125 |
| 5,117,507 | 6/1992 | Long | 2/125 X |
| 5,125,117 | 6/1992 | Buenos et al. | 2/123 X |
| 5,308,275 | 5/1994 | Kornbleuth | 2/158 X |
| 5,516,321 | 5/1996 | Kornbleuth | 2/158 X |
| 5,533,209 | 7/1996 | Davis | 2/158 X |

FOREIGN PATENT DOCUMENTS

| | | |
|---|---|---|
| 574763 | 12/1993 | European Pat. Off. . |
| 295 17 484 | 1/1996 | Germany . |

*Primary Examiner*—C. D. Crowder
*Assistant Examiner*—Shirra L. Jenkins
*Attorney, Agent, or Firm*—Wall Marjama & Bilinski

[57] ABSTRACT

A long-sleeved garment having a sleeve with a cuff attached thereto along an annular seam. A pocket connected to an inner side of the sleeve and cuff along a portion of the annular seam accommodates all fingers of a hand except for the thumb. A thumb compartment extends from the sleeve above the cuff for accommodating the thumb of the hand. Both the pocket and thumb compartment are retractable inside the sleeve such that they are unnoticeable when not in use.

23 Claims, 7 Drawing Sheets

SLEEVED GARMENT HAVING RETRACTABLE HAND WARMERS

BACKGROUND OF THE INVENTION

This application claims the benefit of U.S. Provisional Application No. 60/023,234 filed Aug. 21, 1996.

The present invention is directed to a sleeved garment having retractable finger covering compartments.

There are several known sleeved garments having mittens or the like attached or connected to the end or exterior of a sleeve to protect the hand of a wearer from the elements.

Wright U.S. Pat. No. 361,250 discloses a mitten made from an extension of sleeve material. The mitten can be folded back upon the cuff of the sleeve by opening a flap secured to the sleeve via buttons. The mitten and the cuff itself are again folded back and secured in place by buttons on the flap. The structure of the retracted/folded mitten and cuff resemble a French cuff.

Hertz U.S. Pat. No. 1,092,047 discloses a storm sleeve having an extendable cuff formed on the outside of the sleeve. The cuff can be extended to form a mitten, in the same manner as in Wright.

Aron U.S. Pat. No. 1,183,792 discloses a convertible sleeve opening wherein a cuff can be converted into a mitten. In Aron, a part of an opening of an entire mitten or glove is attached to an inside portion of a sleeve. In an extended position, the mitten or glove extends beyond the end of the sleeve. When folded, the mitten or glove folds back along the outside of the sleeve.

Kaufman U.S. Pat. No. 1,296,966 shows a combined sleeve and mitten arrangement. Like Aron, Kaufman discloses an entire mitten attached to a sleeve. In this case, however, the mitten is attached to the end of the sleeve instead of to an interior portion thereof. To permit a hand to enter the mitten, the open end of the mitten is connected to the sleeve only partially around the circumference thereof. The entire mitten can be retracted inside the sleeve and stored in a pocket sewn to an inside surface of the sleeve.

Gertz U.S. Pat. No. 2,675,554 show a mitten attached to the end of a sleeve of a garment. The mitten includes an open distal end bordered by an extensible elastic member so that a wearer's hand can penetrate the opening. When the distal end is penetrated, the elastic member functions as a wrist band. To use the mitten, the wearer's hand is retracted through the elastic member and the elastic member closes the open distal end adjacent the wearer's finger tips.

O'Hayer U.S. Pat. No. 2,677,130 discloses an infant's garment or night shirt having sleeves with front and back sections having different lengths. A mitten top is sewn to the longer sleeve back and extends beyond the end of the sleeve front, thereby creating a fully closed pocket. The resulting mitten can be turned inside out so that the wearer's hand is not encased in the pocket or mitten.

Buenos et al. U.S. Pat. No. 4,756,027 disclose a cuff that can be folded out and fully converted into a mitten to cover and enclose the hand of a wearer. When retracted, the mitten is folded back against the outside of the sleeve to form the cuff. The cuff conceals the thumb of the mitten.

There are several problems with these prior art sleeved garments. First, the construction of the mitten and thumb compartments tends to add bulk to the end region of the sleeve. None of the prior structures lends itself to minimization of extra material at the end of the sleeve. Each of the prior art structures are readily noticeable by sight, and also are readily noticeable to the wearer by feel.

The prior art fails to provide a sleeved garment having a retractable mitten and/or thumb compartment wherein, when the mitten and/or thumb compartment is retracted, the sleeved garment appears as though no additional appendages are attached or connected to the sleeve. There has yet to be proposed a long-sleeved garment including a mitten and/or thumb compartment connected thereto such that the mitten and/or thumb compartment is substantially unnoticeable when not in use, does not interfere with a wearer's hand or wrist, and is easy and cheap to manufacture.

SUMMARY OF THE INVENTION

It is therefore an object of the present invention to provide a long-sleeved garment having a retractable four-finger compartment, or pocket, and separate thumb compartment.

It is another object of the present invention to provide a long-sleeved garment having retractable four-finger and thumb compartments, wherein when the compartments are in a retracted position they are essentially unnoticeable.

It is yet a further object of the present invention to provide a simply constructed, easy to manufacture and inexpensive long-sleeved garment with retractable four-finger and thumb compartments.

The present invention provides a long-sleeved garment having a sleeve with an open end through which the hand of a wearer extends. A retractable pocket is attached to an inner side of the sleeve. The pocket, when in an extended position, can accommodate the fingers of a wearer and, when in a retracted position, can be stored completely within the sleeve.

In accordance with the present invention a separate retractable thumb compartment extends from the sleeve to accommodate a thumb of a wearer's hand. The thumb compartment, in a retracted position, can also be stored completely within the sleeve.

Further in accordance with the present invention a portion of the sleeve is disposed between a base region of the thumb compartment and the pocket.

For convenience, the four-fingered compartment will be referred to hereinafter exclusively as a "pocket".

BRIEF DESCRIPTION OF THE DRAWINGS

The above and other objects of the present invention will be better understood by reading the following detailed description of the preferred embodiments of the invention, when considered in connection with the accompanying drawings, in which.

DETAILED DESCRIPTION OF THE PREFERRED EMBODIMENTS

Figure 1:
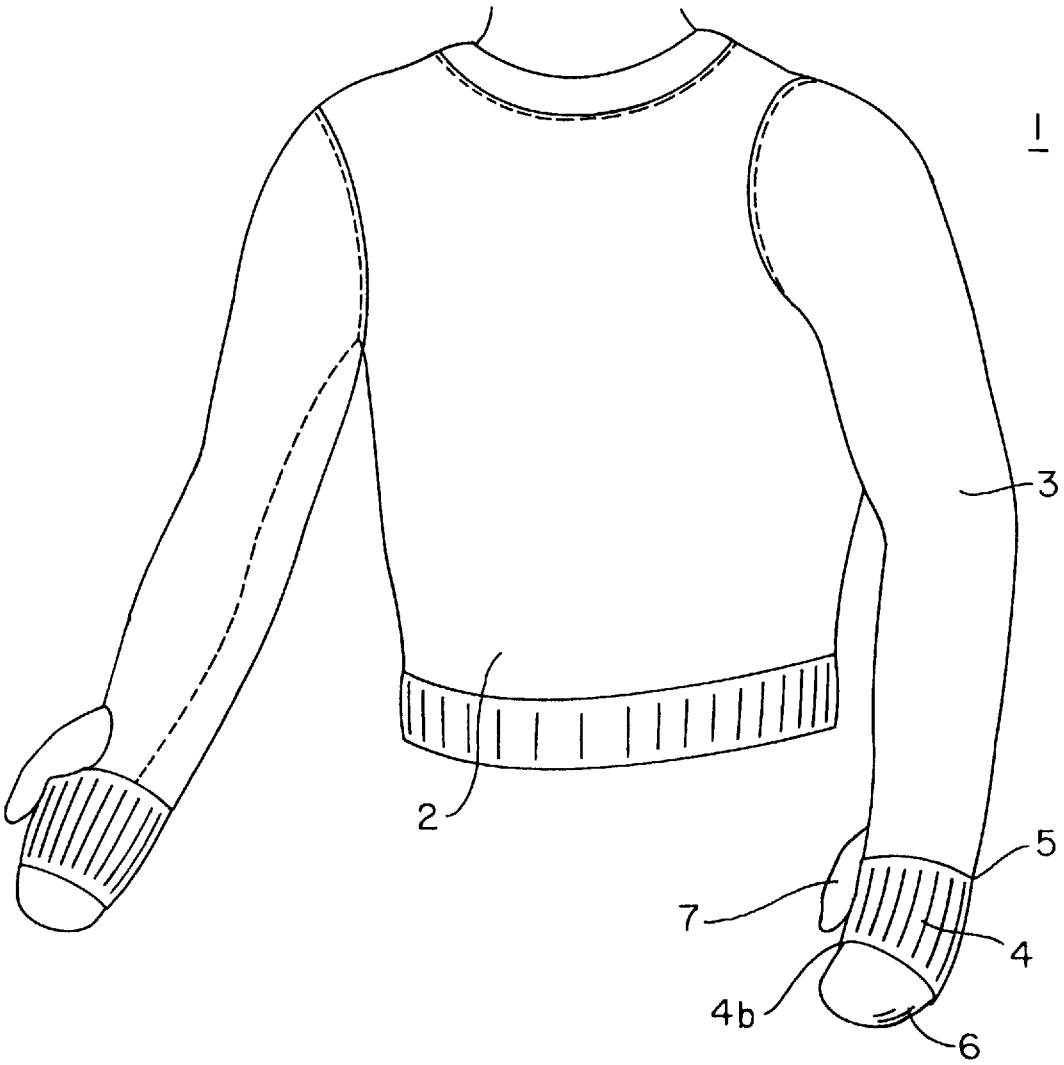
FIG. 1 shows a garment of the present invention with pocket and thumb compartment extended.
Figure 2:
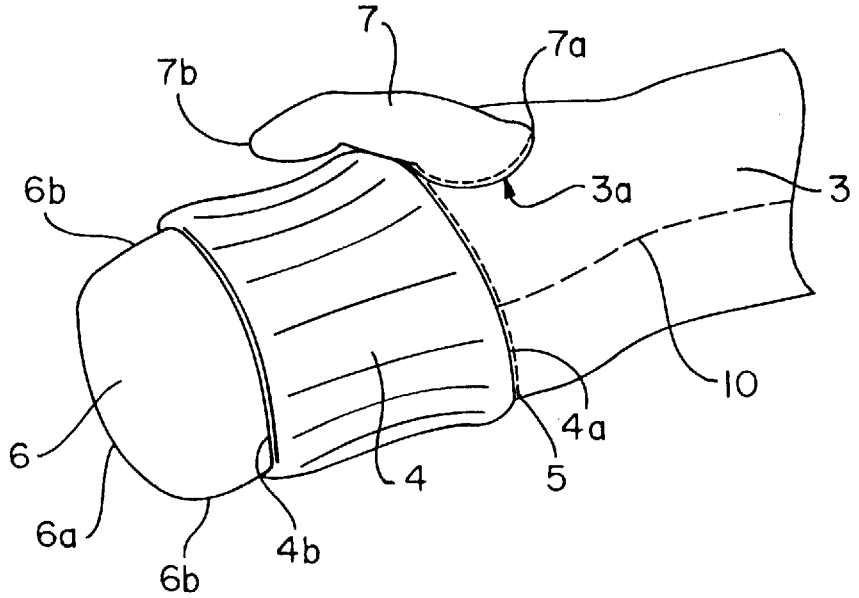
FIG. 2 shows a close up view of the pocket and thumb compartment according to the present invention.

Referring to FIGS. 1 and 2, a long sleeved garment 1 according to the present invention is indicated generally. Garment 1 includes a torso portion 2 and sleeves 3 attached by known means to the torso portion 2. Each sleeve 3 preferably includes a cuff 4 having a cuff attachment end 4*a* and a cuff distal end 4*b*. Preferably, the cuff 4 is attached to the sleeve 3 at the cuff attachment end 4*a* via an annular cuff seam 5. Preferably the cuff 4 includes elastic fibers for constricting the cuff 4 around the wrist of a wearer. Preferably, sleeve 3 has a first elasticity and cuff 4 has a second elasticity greater than the first elasticity. The present invention is also applicable to long-sleeved garments having no cuff at all. Also shown, and explained in more detail herein below, are a pocket 6 and thumb compartment 7.

FIG. 2 depicts the arrangement of the sleeve 3, cuff 4, pocket 6 and thumb compartment 7 according to the present invention. The view of FIG. 2 represents a right arm sleeve and shows an inside longitudinal sleeve seam 10 running along the length of the sleeve 3 and ending, generally, at the cuff attachment end 4*a* and cuff seam 5.

The pocket 6, in an extended position for receiving four fingers of a wearer's hand, includes a distal end 6*a* and sides 6*b*. As can be partially seen in FIG. 2, sides 6*b* are not attached to an inside portion of cuff 4. That is, pocket 6 is free to move in any direction with respect to the cuff 4 without being restricted thereby.

The thumb compartment 7 is a tubular-like member having an open end 7*a* and a closed end 7*b*. Open end 7*a* is connected to a corresponding hole 3*a* in sleeve 3 at a position adjacent cuff attachment end 4*a* and annular seam 5. Hole 3*a* can be immediately next to annular seam 5, or may be axially spaced therefrom depending upon the desired location of the wearer's hand relative to the opening of the sleeve/cuff. An advantage of providing thumb compartment 7 above cuff 4 is that the finger-thumb functionality of the wearer's hand is surprisingly maintained. Preferably, hole 3*a* is located approximately 90 degrees radially offset from the longitudinal sleeve seam 10, thereby providing an anatomically comfortable fit for a wearer's hand.

Figure 3:
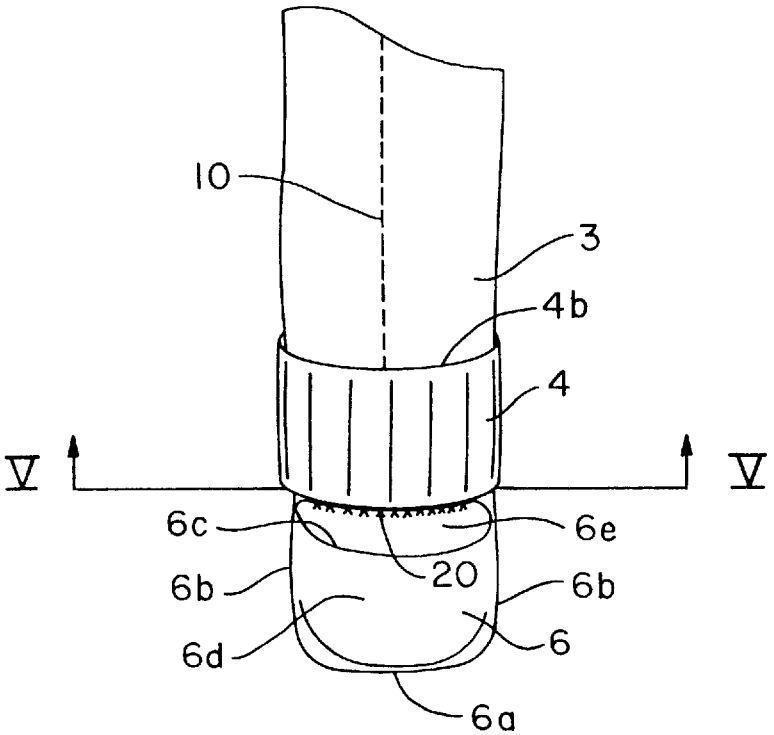
FIGS. 3 and 5 show details of the connection between the pocket, sleeve and cuff (with the cuff folded back on the sleeve) according to the present invention.
Figure 4A:
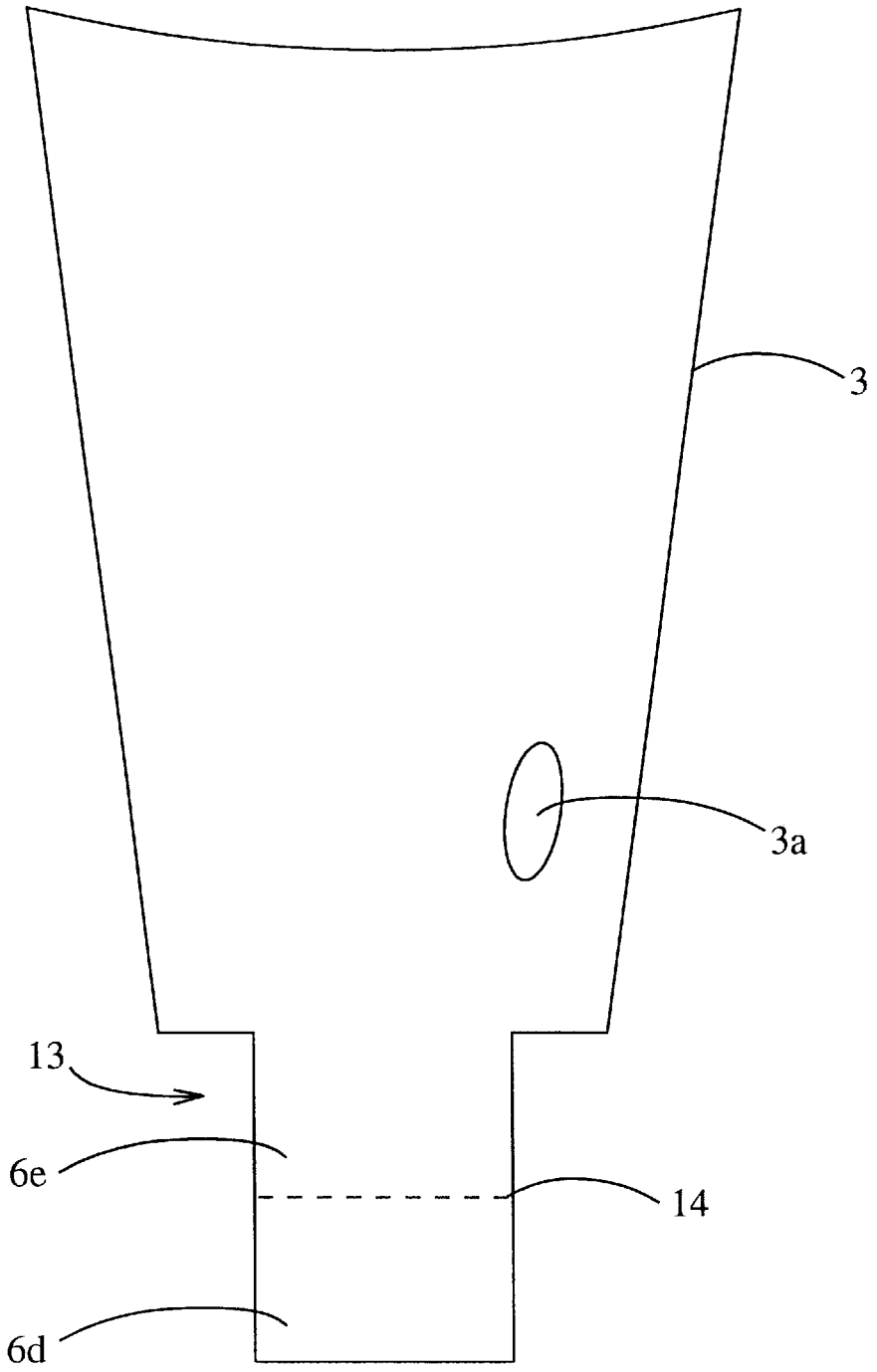
FIGS. 4A and 4B show alternative manners for fabricating the pocket and thumb compartment of the present invention.
Figure 4B:
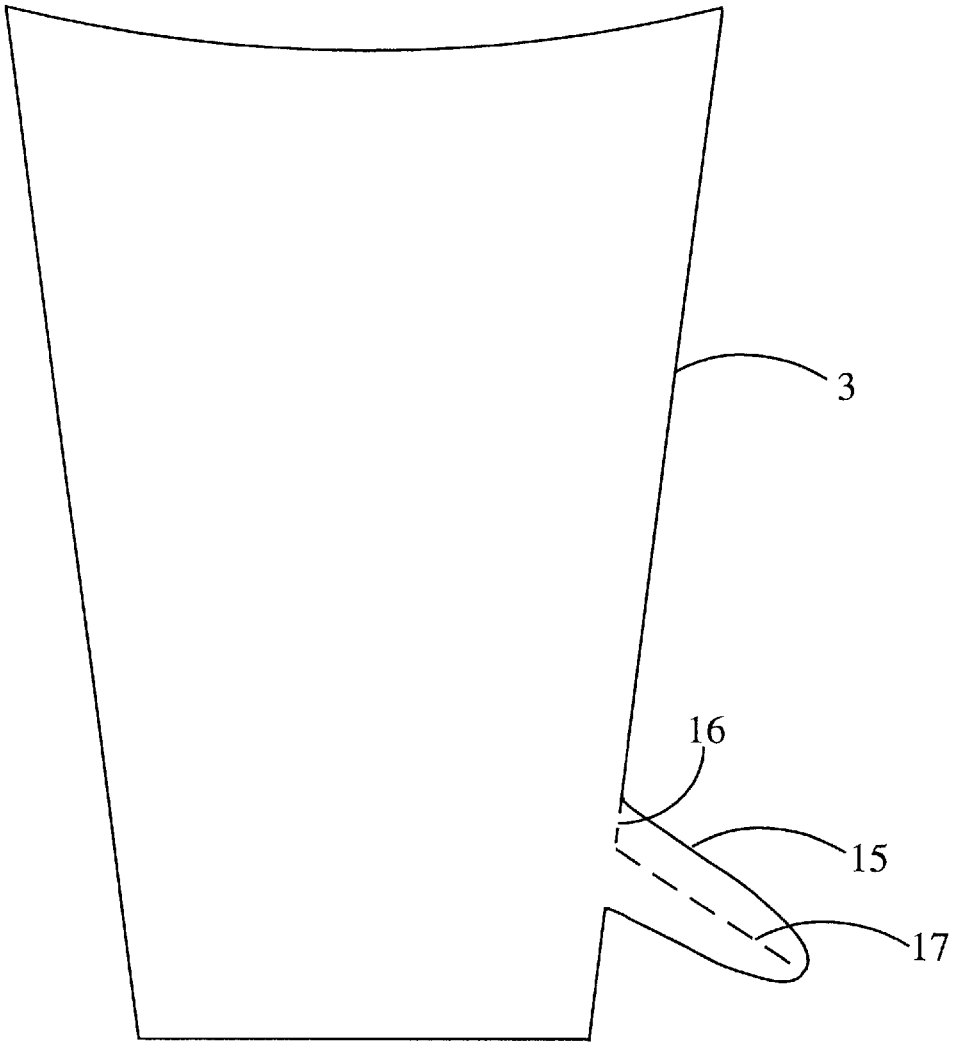
Figure 5:
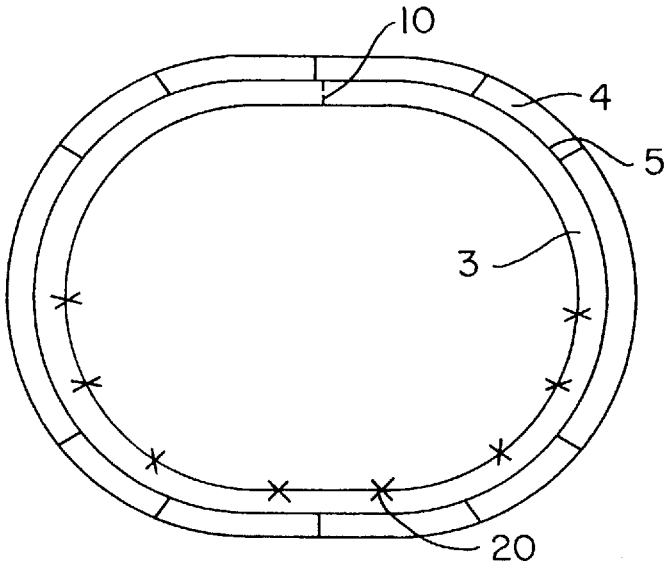

FIGS. 3–5 show an example of how pocket 6 is preferably connected to garment 1. In particular, FIG. 3 shows cuff 4 turned up around sleeve 3 thereby exposing all of pocket 6 and blocking the view of thumb compartment 7. As can be seen from FIG. 3, pocket 6 takes the form of a compartment with an open end 6*c*. FIG. 3 also shows that pocket 6 is fully detached from the distal end 4*b* of cuff 4. That is, there is no direct connection between the outer open end of cuff 4 and pocket 6. The pocket 6 preferably has a length measured in the direction of the longitudinal sleeve seam 10 greater than the cuff 4. Further the pocket 6 includes two relatively planar sides 6*d* and 6*e*, planar side 6*d* having, if desired, a slightly shorter length than planar side 6*e*. The length of cuff 4 is preferably intermediate the lengths of planar sides 6*d* and 6*e* so that the cuff, when extended, covers the opening in pocket 6, but does not necessarily cover the entire pocket 6. See FIG. 2 in this regard. Connection of the pocket 6 to the sleeve 3 and cuff 4 is accomplished by, for example, stitching 20 at an end portion of planar side 6*e* to a portion of annular seam 5.

Alternatively, at the time of cutting material for the overall sleeve 3, an extra flap 13 can be cut to extend from the end of the sleeve 3. As shown in FIG. 4A, the flap 13 can then be folded upon itself along fold line 14 and closed on three sides thereby providing closed sides 6*a*, 6*b* and providing the pocket 6. The thumb compartment 7 can also be cut from the same piece of material as the sleeve and pocket, as shown in FIG. 4B.

FIG. 5 is a cross sectional view of the sleeve of FIG. 3 showing the extent and location of connection between pocket 6 and sleeve 3 and cuff 4. As shown, pocket 6 is connected by stitches 20 substantially opposite longitudinal sleeve seam 10 and is connected along approximately half of annular cuff seam 5. This arrangement permits easy access of a wearer's fingers into pocket 6. The pocket could be attached to the inner surface of the sleeve above the cuff or on the inner surface of the cuff itself, depending upon the size of the wearer's hand. It is important that pocket 6 be connected to the inner surface of the cuff or sleeve, however, to facilitate storage of the pocket. The preferable location is as shown, since this location permits easy storage of pocket 6 in the bulkier portion of the sleeve immediately above the cuff.

Figure 6:
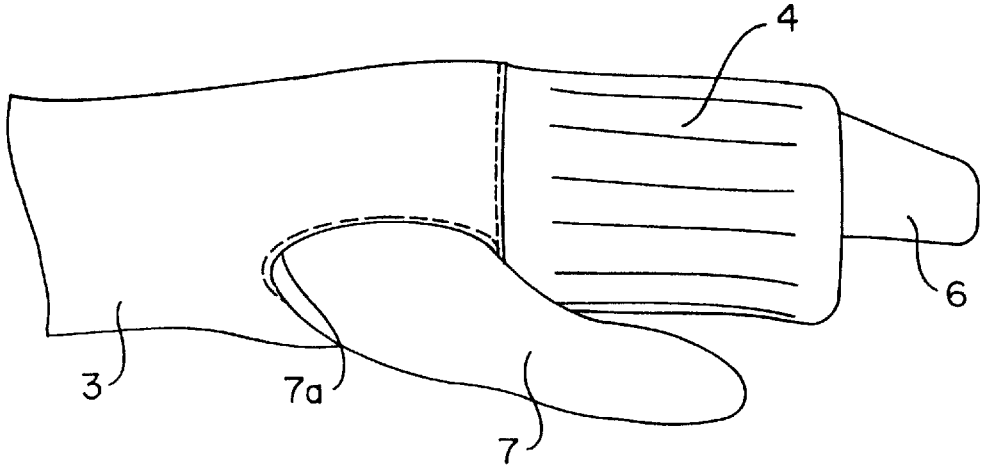
FIG. 6 shows details of the thumb compartment according to the present invention.

FIG. 6 shows a view of a left hand sleeve wherein thumb compartment 7 is clearly shown. Thumb compartment 7 is connected (e.g., stitched) to sleeve 3 adjacent cuff 4 and annular seam 5. Furthermore, thumb compartment 7 is located in an anatomically correct position with respect to the other four fingers of a wearer's hand positioned in pocket 6.

Thumb compartment 7 can also be cut from the same piece of material as the sleeve, as shown in FIG. 4B. In this case, a flap 15 is positioned off-center so as to insure proper orientation with the thumb compartment after assembly. In the arrangement shown in FIG. 4B, flap 15 is preferably cut along line 16, folded along line 17 and then stitched along an outer edge.

Figure 7:
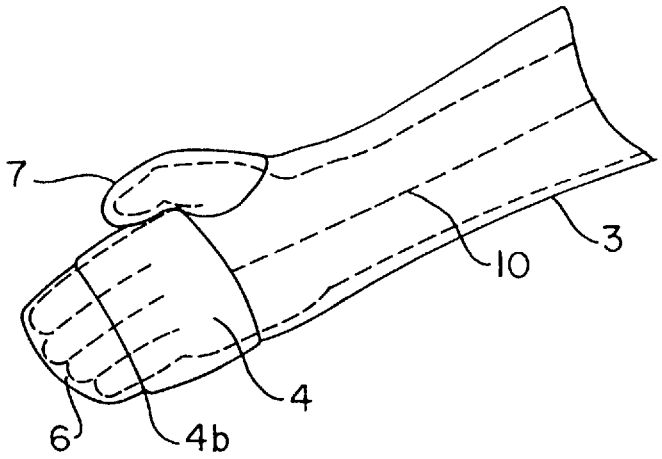
FIG. 7 shows a wearer's hand inside the pocket and thumb compartment.

FIG. 7 shows how the present invention interacts with a wearer's hand. When used, pocket 6 is placed in an extended position by unfolding or unfurling same from inside cuff 4, or more preferably, sleeve 3, thereby enabling the wearer's fingers to easily slip into pocket 6. Further, the wearer's thumb fits comfortably inside thumb compartment 7, which is also unfurled from inside sleeve 3. As shown, no portion of the hand or thumb is exposed to the outside elements. That is, the thumb, fingers and palm of the wearer's hand are always covered by material and protected from the elements. Moreover, as illustrated in both FIGS. 6 and 7, the palm, a posterior portion, and even a portion of the fingers of a wearer's hand are covered by both cuff 4 and pocket 6, thereby providing additional protection from, for example, cold weather.

Preferably sleeve 3 either has sufficient length or is sufficiently stretchable so that when a wearer uses the pocket 6 and thumb compartment 7 the garment 1 maintains a comfortable fit.

Figure 8:
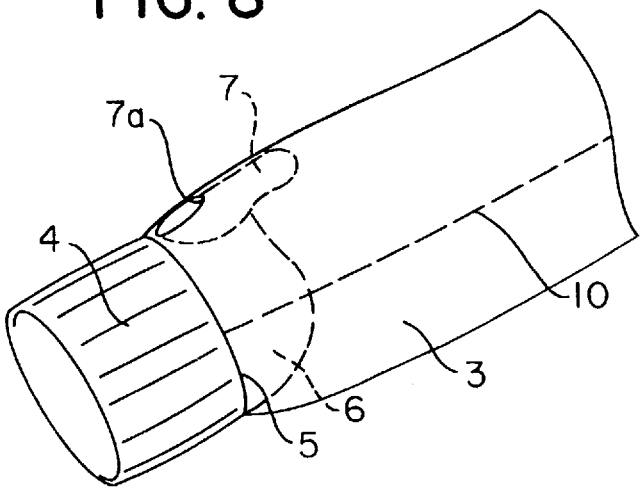
FIGS. 8 and 9 show, respectively, the pocket and thumb compartment in a retracted position, and a wearer wearing the garment in that position.
Figure 9:
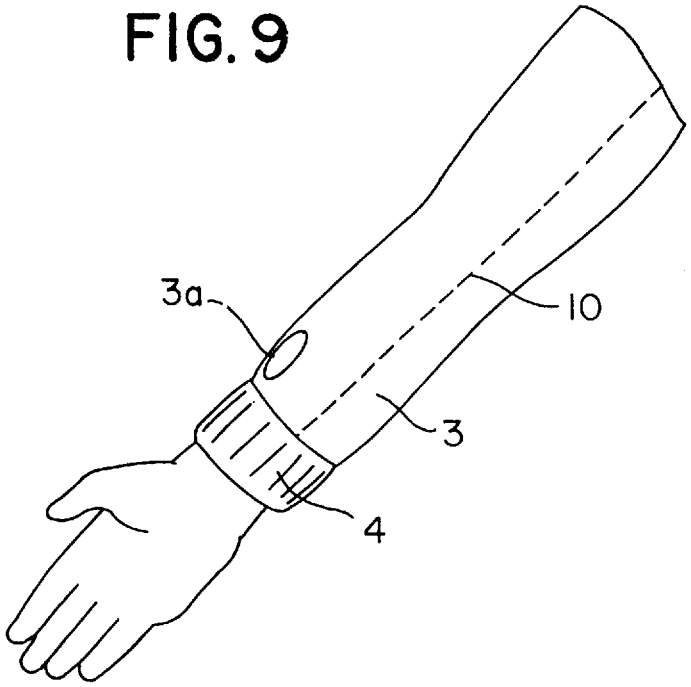

FIGS. 8 and 9 depict, respectively, pocket 6 and thumb compartment 7 in a retracted position and how, generally, sleeve 3 and cuff 4 appear in that condition.

To retract pocket 6, it is preferably folded back and up into sleeve 3, thereby removing the bulk of the material away from the inside of the cuff 4. Accordingly, pocket 6 does not interfere with the normal function of cuff 4 or crowd/bother a wearer's wrist. Also, thumb compartment 7 is turned inside out and drawn into sleeve 3, leaving only, depending on the type and color of material used for the garment, an almost imperceptible hole 3*a* in sleeve 3, as shown in FIG. 9. It can also be seen from FIG. 9 that a portion of sleeve 3 is disposed between a base region (delineated by hole 3*a*) of thumb compartment 7 and pocket 6.

Figure 10:
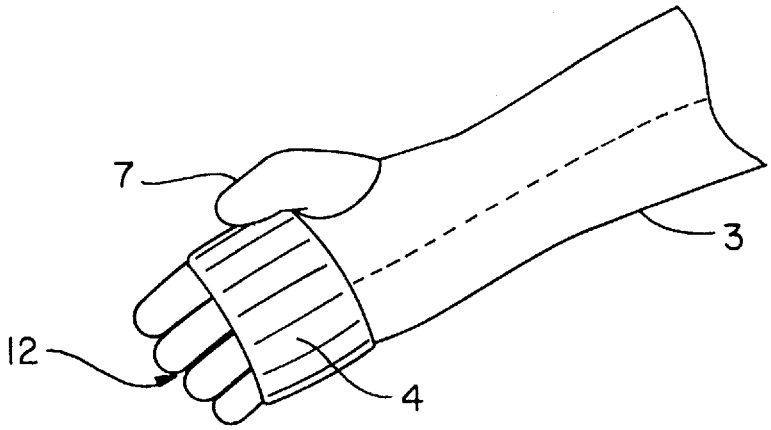
FIG. 10 shows a second embodiment of the present invention.

In a second embodiment of the invention, shown in FIG. 10, pocket 6 can be replaced with a glove-like structure 12 that can accommodate each finger individually. All other features of the embodiment shown in FIG. 10 are the same as those associated with the first embodiment.

Various changes and modifications, other than those described above, in the preferred embodiments of the invention described herein will be apparent to those skilled in the art.

For example, the integral pocket and thumb compartment variations shown in FIGS. 4A and 4B can be combined. Furthermore, the embodiment shown in FIG. 10 can be modified such that, for example, only the index finger is enclosed in a first appendage and the other fingers, except the thumb, are covered by a second appendage.

We claim:

1. A long-sleeved garment, comprising:

a sleeve;

a cuff attached to said sleeve at one end thereof along an annular seam;

a retractable pocket connected to an inner side of said sleeve and cuff along a portion of said annular seam, said pocket accommodating all fingers of a hand except for the thumb thereof; and a retractable thumb compartment extending from said sleeve for accommodating the thumb of the hand.

2. The garment of claim 1, wherein at least one of said pocket and said thumb compartment is retractable into said sleeve.

3. The garment of claim 1, further comprising a seam running longitudinally along said sleeve and wherein said pocket is connected opposite said longitudinal seam.

4. The garment of claim 1, wherein said pocket and said thumb compartment are extended from a retracted position to an extended position to accommodate all fingers of the hand.

5. The garment of claim 1, wherein said pocket is open only along one end thereof, and said pocket is connected to said portion of said annular seam in the region of said one end.

6. The garment of claim 5, wherein said pocket is foldable along its point of connection with said annular seam for storage within said sleeve.

7. The garment of claim 1, wherein said cuff and said pocket collectively cover palm and posterior portions of the hand when the fingers of the hand are positioned in said pocket.

8. The garment of claim 1, wherein said pocket comprises individual appendages for separately accommodating fingers except the thumb.

9. The garment of claim 1, wherein said thumb compartment is formed as an integral extension of said sleeve.

10. The garment of claim 1, wherein said pocket is formed as an integral extension of said sleeve.

11. The garment of claim 1, wherein said cuff comprises elastic fibers.

12. The garment of claim 3, wherein an opening of said thumb compartment is radially offset about 90 degrees with respect to said longitudinal seam.

13. The garment of claim 1, wherein said sleeve has a first elasticity and said cuff has a second elasticity greater than the first elasticity.

14. The garment of claim 1, wherein said pocket is fully detached from an outer open end of said cuff.

15. The garment of claim 1, wherein said thumb compartment is adjacent said annular seam.

16. A long-sleeved garment, comprising:

a sleeve having a longitudinal seam and an open end through which the hand of a wearer extends; a cuff connected to the open end of said sleeve;

a pocket connected to a portion of an inner side of said sleeve or said cuff, said pocket accommodating all fingers of the hand except for the thumb thereof; and a thumb compartment extending directly from said sleeve for accommodating the thumb of the hand, said thumb compartment having a base region attached to said sleeve.

17. The garment of claim 16, wherein a portion of said sleeve is disposed between a base region of said thumb compartment and said pocket.

18. A long-sleeved garment, comprising:

a sleeve having an open end through which the hand of a wearer extends;

a cuff attached to said sleeve at one end thereof along an annular seam;

a retractable pocket attached only to an inner side of said sleeve at said sleeve, said pocket accommodating at least the fingers of the wearer when in an extended position, and being stored completely within said sleeve when in a retracted position.

19. The garment of claim 18, wherein a portion of said sleeve proximate said open end thereof covers at least a portion of the hand of the wearer.

20. The garment of claim 19, wherein said portion of said sleeve covers at least a portion of the fingers of the wearer.

21. The garment of claim 18, wherein said pocket is attached to said inner side of said sleeve at a position spaced from said open end thereof, such that a portion of said sleeve proximate said open end thereof covers a portion of said pocket when in said extended position.

22. The garment of claim 18, wherein said pocket is fully detached from a distal portion of said open end of said sleeve.

23. The garment of claim 18, wherein said sleeve comprises a cuff defining the open end thereof, and said retractable pocket is attached to said inner side of said sleeve above the cuff.

* * * * *

UNITED STATES PATENT AND TRADEMARK OFFICE

CERTIFICATE OF CORRECTION

PATENT NO. : 5,815,837

DATED : October 6, 1998

INVENTOR(S) : Mr. Rodney Gene Christman and Ms. Amy Jo Kasza-Christman

It is certified that error appears in the above-identified patent and that said Letters Patent is hereby corrected as shown below:

On the title page: Item

-- [60] Provisional Applications:

No: 60/023,234 August 21, 1996, and Provisional Application
No: 60/037,646 January 22, 1997

Column 1, line 6, after "1996", insert --and claims benefit of U. S. Provisional Application No. 60/037,646, filed Jan. 22, 1997--.

Signed and Sealed this

Thirtieth Day of March, 1999

*Attest:*

Q. TODD DICKINSON

*Attesting Officer*

*Acting Commissioner of Patents and Trademarks*